US005517697A

United States Patent [19]

Boehm

[11] Patent Number: 5,517,697

[45] Date of Patent: May 21, 1996

[54] NON-SLIP UNIFORM BELT AND METHOD OF MANUFACTURE

[76] Inventor: Thomas J. Boehm, 119 Hidden Valley Rd., McMurray, Pa. 15317-3540

[21] Appl. No.: 490,907

[22] Filed: Jun. 16, 1995

[51] Int. Cl.[6] ..... A41F 3/02

[52] U.S. Cl. ..... 2/338; 2/311

[58] Field of Search ..... 2/338, 311, 312, 2/243.1, 336

[56] References Cited

U.S. PATENT DOCUMENTS

| | | | |
|---|---|---|---|
| 1,071,594 | 8/1913 | Smith | 2/338 |
| 1,531,994 | 3/1925 | Starmer . | |
| 1,705,790 | 3/1929 | Tallman | 2/338 |
| 2,217,517 | 10/1940 | Lances | 2/338 |
| 2,396,329 | 3/1946 | Lippmann | 2/338 |
| 2,663,027 | 12/1953 | Posson . | |
| 2,941,914 | 6/1960 | Ouimet | 2/338 |

FOREIGN PATENT DOCUMENTS

| | | | |
|---|---|---|---|
| 2728023 | 1/1979 | Germany | 2/338 |

*Primary Examiner*—C. D. Crowder
*Assistant Examiner*—Gloria Hale
*Attorney, Agent, or Firm*—Webb Ziesenheim Bruening Logsdon Orkin & Hanson

[57] ABSTRACT

A belt for use with a clamp type buckle having a sliding cinch bar and a method of making the belt. The belt includes an elongated outer fabric piece having a tab end, a buckle attachment end opposite the tab end and a pair of substantially parallel outer edges. Two thickening strips extend along the entire length of the belt and a spine member is sandwiched between the strips adjacent to the tab end of the belt. The length of the spine member is less than the length of the belt. The fabric piece is folded around the thickening strips and the spine member which are secured by stitches.

19 Claims, 1 Drawing Sheet

NON-SLIP UNIFORM BELT AND METHOD OF MANUFACTURE

BACKGROUND OF THE INVENTION

1. Field Of The Invention

This invention relates generally to uniform belts and, more particularly, to a military-style belt which resists slippage relative to a clamp type belt buckle.

2. Description Of The Prior Art

A regulation military-style belt is a required part of each uniform worn by members of the United States Armed Forces. The belts are made of an approved fabric and have a metal tab fixed at one end. The belt includes a clamp type buckle having a sliding cinch bar mounted in an inclined cam slot rather than the more common belt buckle which has a pivoted tongue for engaging holes spaced longitudinally along the end of the belt having the tab attached thereto. The tab end of the belt is slipped through a passage in the buckle and is held in place by force exerted by the roughened surface of the sliding cinch bar against the rear surface of the belt. The clamp type buckle is attached to the end of the belt opposite the tab end by a pivoted clamp member connected to the rear of the buckle. The operation of a military clamp type buckle is well known to those skilled in the art.

A common problem with known uniform belts is that the belt tends to flatten quickly and the surfaces become shiny and slick under the force of the cinch bar and loses its resiliency which allows the tab end of the belt to slip out of the belt buckle. This makes it difficult to maintain a snug non-slip fit between the belt and the cinch bar on the buckle which results in a general overall sloppy appearance of the wearer. In the naval service for example, the tab on the tab end of the belt must align with an imaginary vertical line, called the "gig line", formed by the button flap of the wearer's shirt, the end of the tab on the wearer's belt and the zipper flap on the wearer's trousers. This alignment is impossible to maintain if the tab end of the belt continuously slips relative to the buckle. Personal appearance is an important concern for members of the armed services. Not only does personal appearance reflect pride in the service, it is one of the factors considered in recommending promotions.

To facilitate the wearer's ability to properly align the belt with the rest of the wearer's uniform, it is common practice when removing or adjusting existing belts to leave the tab end of the belt fixed in the buckle and to remove or adjust the belt by opening the pivoted clamp member on the back of the buckle and sliding the other end of the belt therethrough. Therefore, it is very important that the tab end of the belt be securely held in place in the buckle at all times.

Further, if the tab end of the belt slips entirely out of the buckle, the tab end and the buckle will hang loosely from the belt loops on the wearer's trousers and may become entangled in operating machinery. This is of particular concern for personnel who live and work close to constantly operating machinery, such as naval personnel stationed onboard ships and submarines.

Belts are known which contain stiffening elements to prevent crimping of the belt during use. U.S. Pat. No. 2,396,329 to Lippmann discloses a belt having a fabric insert of thermoplastic material of an organic derivative of cellulose. The belt with the cellulose insert is heated and pressurized to coalesce the insert to the inner surface of the covering fabric. U.S. Pat. No. 1,531,994 to Starmer discloses a belt which will maintain its shape during use. The belt includes an inner stiffening member and may also include a stiffening wire located at one end to prevent curling of the belt. U.S. Pat. No. 2,663,027 to Posson discloses an elastic belt designed to be worn on the inside of trousers. While these patents discuss the importance of belts which will retain their shape, they do not disclose a belt having a clamp type buckle which avoids slipping relative to the cinch bar of the buckle.

Therefore, it is an object of the invention to provide an inexpensive and easy to manufacture uniform belt which meets the specifications and requirements of the armed services, particularly the naval service. It is a further object of the present invention to provide a belt which is not prone to slipping relative to a clamp type buckle during use.

SUMMARY OF THE INVENTION

The belt according to the present invention is used with a buckle having a sliding cinch bar. The belt includes an elongated outer fabric piece having a tab end, a buckle attachment end opposite to the tab end and a pair of substantially parallel side edges. At least two thickening strips extend along substantially the entire length of the belt. A spine member is sandwiched between the thickening strips adjacent to the tab end. The spine member has a length substantially less than the length of the thickening strips and the fabric piece. The outer fabric piece is folded around each of the thickening strips and the fabric piece is then folded along its longitudinal center line. The spine member is inserted between the opposed surfaces of the thickening strips. Securing means are provided to secure the fabric piece around the thickening strips and spine member.

The present invention also relates to a method for making a belt for use with a clamp type buckle having a sliding cinch bar. Fabric is cut to form a substantially elongated rectangular fabric piece having a longitudinal center line, a tab end, a belt attachment end and two substantially parallel elongated side edges. A pair of substantially rectangular thickening strips having elongated edges are placed on a surface of the fabric piece such that the thickening strips are spaced from each other along the longitudinal center line of the fabric piece. The outer edge of each thickening strip is spaced inwardly from an elongated side edge of the fabric piece to form flap portions on the opposite elongated side edges of the fabric piece. The flap portions of the fabric piece are then folded over the outer edges of the thickening strips and a spine member is placed on the exposed surface of one of the thickening strips adjacent to the tab end of the fabric piece. The fabric piece is folded along the longitudinal center line until the exposed surfaces of the flap portions abut. The thickening strips, spine member and folded fabric piece are secured together by stitching to form the finished fabric portion of a belt. The metal tab is attached to the tab end of the fabric portion of the belt.

A complete understanding of the invention will be obtained from the following description when taken in connection with the accompanying drawing figures wherein like reference characters identify like parts throughout.

DESCRIPTION OF THE PREFERRED EMBODIMENT

Figure 1:
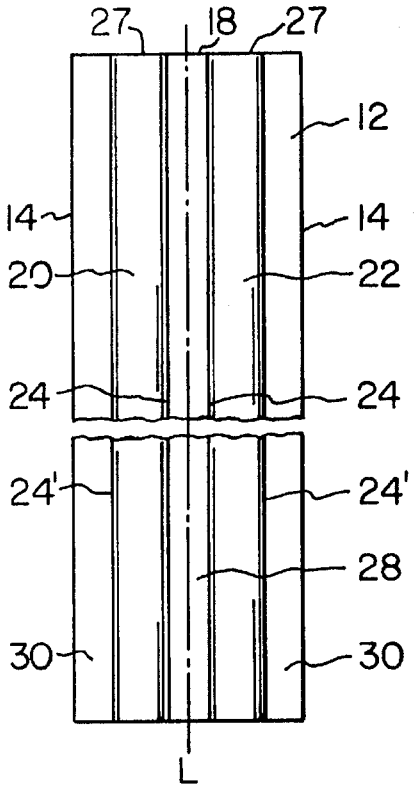
FIG. 1 is a plan view of an end of a belt showing the thickening strips placed on a fabric piece.

A military-style uniform belt of the present invention is generally designated 10 in the drawings. Fabrication of the belt 10 is described hereinafter. As shown in FIG. 1 of the drawings, an elongated rectangular fabric piece 12 is cut to a predetermined finite length and finite width and is laid out flat. The fabric is a type authorized by military regulations to be worn with the particular uniform for which the belt 10 is being made. Elongated fabric piece 12 has a longitudinal center line L, two substantially parallel elongated side edges 14, a tab end and a buckle attachment end 18. Fabric piece 12 is preferably 3.25 inches wide and is cut to a standard length of 44 inches.

Next, thickening strips 20 which is preferably 0.028 inch ±0.003 inch thick and 22 which is preferably 0.040 inch ±0.003 inch thick of a polyurethane material, commonly called Castillian, are sprayed on the bottom surfaces with a non-toxic glue and are placed on the top surface of fabric piece 12 as shown in FIG. 1 of the drawings. Each of the thickening strips 20 and 22 has a finite length and finite width is substantially rectangular in shape and includes an inner edge 24 and an outer edge 24', a tab end and a buckle attachment end 27. In the preferred embodiment, strips 20 and 22 are about 1.375 inches wide and 44 inches long for a man's belt and 38 inches long for a woman's belt. The strips 20 and 22 are placed adjacent to, but spaced from longitudinal center line L, to form a center space 28 between the inner edges 24 of strips 20 and 22. The outer edges 24' of strips 20 and 22 are spaced inwardly from the edges 14 of fabric piece 12 by a distance of approximately 0.25 inch to form flap portions 30 on fabric piece 12 extending beyond the outer edges 24' of the strips 20 and 22.

Figure 2:
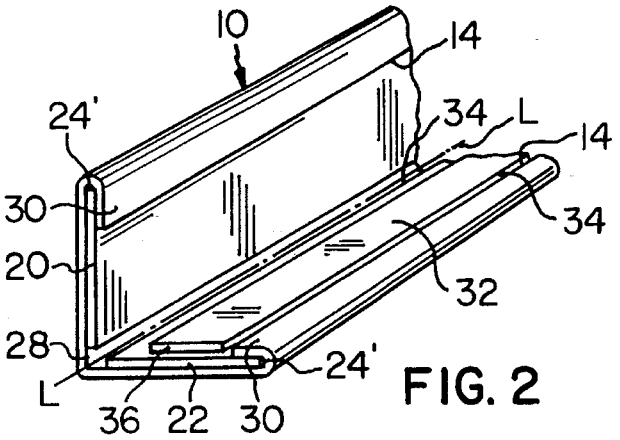
FIG. 2 is a perspective view of the tab end of a partially assembled belt showing the fabric piece folded along the longitudinal center line.
Figure 4:
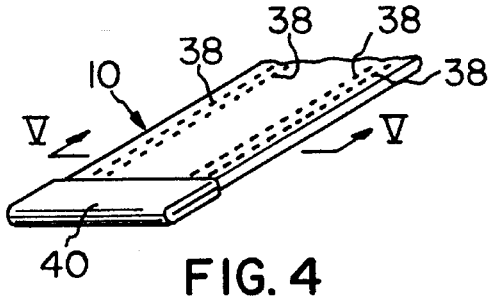
FIG. 4 is a perspective view showing a metal tab attached to an end of a belt.
Figure 3:
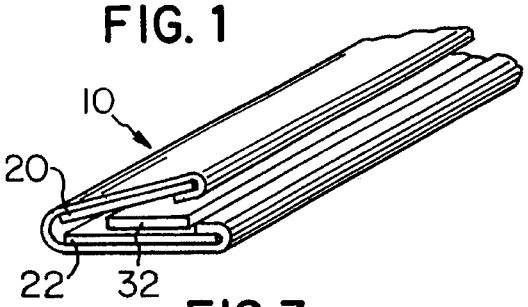
FIG. 3 is a perspective view showing the fabric piece of FIG. 2 folded on itself.
Figure 5:
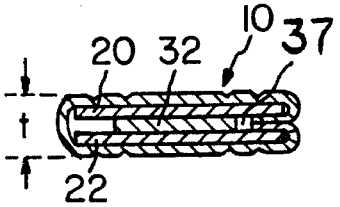
FIG. 5 is a section on line V—V of FIG. 4.

As shown in FIG. 2 of the drawings, flap portions 30 are folded around the outer edges 24' of the thickening strips 20 and 22 such that the edges 14 of the fabric piece 12 fold over the outer edges 24' of strips 20 and 22 and fabric piece 12 is then folded around the longitudinal center line L. A polyurethane spine member 32 is placed on the upper surface of the thickening strip 22 adjacent the tab end of the strip as shown in FIGS. 2, 3 and 5 of the drawings. The spine member 32 is substantially rectangular having a preferred width of about ⅝ inch and a preferred length between 5 inches and 6 inches having a thickness of about 0.028 inch ±0.003. Spine member 32 has a pair of substantially parallel longitudinal edges 34, a tab end 36 and an opposite end (not shown). The spine member 32 is positioned on the upper surface of the thickening strip 22 in an envelope 37 such that tab end 36 of the spine member 32 is recessed about 0.25 inch from the tab end of the strip 22. The opposite longitudinal edges 34 of spine member 32 are recessed about 0.25 inch from the outer edges 24 and 24' of the strip 22.

As shown in FIGS. 3 and 5 of the drawings, the fabric piece 12 is folded around longitudinal center line L until the upper surfaces of folded flap portions 30 abut each other and spine member 32 is sandwiched between the facing surfaces of strips 20 and 22 at the tab end of the belt. Four rows of stitching 38 extend along the entire finite length of the belt 10 to hold the components of the belt together. A metal tab 40 is then fixed to the tab end of the belt in a customary manner, such as by crimping. Applicant has found that recessing the end of the spine member 32 about 0.025 inch in from the tab end of the belt allows the tab 40 to be easily and quickly fixed to the belt and prevents bulging of the tab 40 by the spine member 32.

As shown in FIG. 5 of the drawings, belt 10 adjacent to the tab end has the spine member 32 sandwiched between strips 20 and 22 which are in turn surrounded by fabric piece 12. Flap portions 30 are folded around outer edges 24' of thickening strips 20 and 22 and are positioned between the strips 20 and 22. The overall thickness of the strips 20 and 22 and the spine member 32 are selected such that the overall thickness of the belt 10 i.e., the folded fabric piece, the thickening strips and the spine member, adjacent to the tab end is about 0.160 inch ±0.003 inch and the overall thickness of belt 10 without the spine i.e., the folded fabric piece and the thickening members 32 is about 0.130 inch ±0.003 inch.

Figure 6:
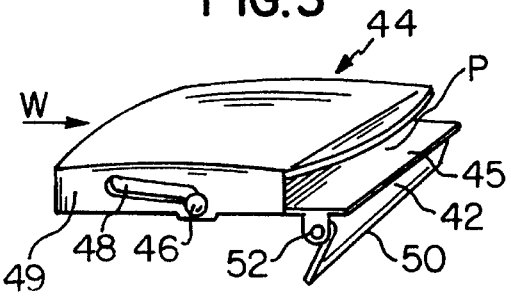
FIG. 6 is a perspective view of a standard clamp type belt buckle.
Figure 7:
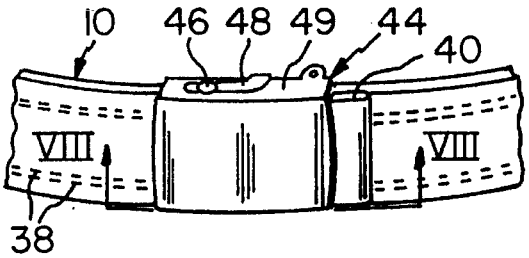
FIG. 7 is a perspective view of a portion of the belt of FIG. 4 held by the buckle of FIG. 6.
Figure 8:
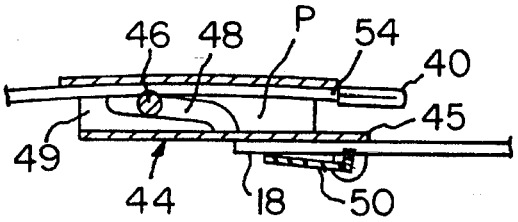
FIG. 8 is a section on line VIII—VIII of FIG. 7.

FIG. 6 of the drawings shows a standard military-style clamp type belt buckle 44 which is well known in the art. Buckle 44 includes a base plate 45 and a cinch bar 46 having a roughened surface which has opposed ends located in inclined cam slots 48 in the spaced sides 49 of the buckle. As shown in FIGS. 6–8 of the drawings, cinch bar 46 extends through a belt passage slot P in buckle 44. When cinch bar 46 is in a fully open position, as shown in FIG. 6, a clearance of about 0.25 inch exists between the cinch bar 46 and the surface of buckle 44 opposite base plate 45. When cinch bar 46 is in the closed position, a clearance of about 0.125 inch exists between cinch bar 46 and the inner surface of buckle 44. A clamp member 50 is pivotally mounted between two posts 52 on the opposite sides 49 of buckle 44.

In order to attach the buckle 44 to the belt 10, buckle attachment end 18 of belt 10 is slipped into a gap 42 between base plate 45 and the clamp member 50. Clamp member 50 is then pivoted such that serrations or teeth (not shown) on the edge of clamp member 50 dig into the inner surface of belt 10 to hold the buckle 44 to buckle attachment end 18 of the belt. To attach the tab end of the belt to the buckle 44, cinch bar 46 is moved to the fully open position and the tab end is slipped into passage P and pulled through the buckle 44 in the direction W indicated by arrow in FIG. 6. As shown in FIGS. 7 and 8 of the drawings, it is usual military practice to pull tab end 16 of belt 10 through passage P until the back edge 54 of the tab just emerges from passage P. Cinch bar 46 is then slid from the open position as shown in FIG. 6 toward the closed position, as shown in FIGS. 7 and 8. Cinch bar 46 rolls along the cam slot 48 until the cinch bar 46 presses against the inner surface of tab end portion of the belt 10 which includes the spine member 32. Since the spine member 32 is present only in the tab end portion of the belt, the remainder of belt 10 maintains a normal military appearance while the added thickness in the tab end portion of the belt caused by spine member 32 helps to prevent the belt 10 from slipping out of the passage P maintaining the belt securely in place on the wearer.

As discussed hereinabove, it is common military practice once back edge 54 of tab 40 is properly positioned in buckle 44 to adjust the length of belt 10 or remove the belt by pivoting clamp member 50 into the open position and sliding the belt 10 through the gap 42. Thus, the tab end of belt 10 must be securely held in buckle 44. Applicant has found that belt 10 not only maintains its stiffness and crisp military appearance due to the presence of thickening strips 20 and 22 running substantially the entire length of belt 10, but also the belt does not slip relative to a military clamp type buckle because the spine member 32 is located in the tab end portion of the belt.

While a preferred embodiment of the invention has been described in detail herein, it will be appreciated by those skilled in the art that various modifications and alternatives to the embodiment could be developed in light of the overall teachings of the disclosure. Accordingly, the particular arrangement is illustrative only and is not limiting as to the scope of the invention which is to be given the full breadth of the appended claims and any and all equivalents thereof.

I claim:

1. A belt for use with a clamp type buckle having a sliding cinch bar, said belt comprising:

an elongated fabric piece having a finite length, a finite width and a tab end, a buckle attachment end opposite said tab end, a longitudinal central axis, a pair of substantially parallel edges on opposite sides of said longitudinal central axis and outer and inner surfaces;

two elongated thickening strips extending along substantially said finite length of said elongated fabric piece and having an outer surface attached to the inner surface of said elongated fabric piece and an inner surface;

wherein said elongated fabric piece is folded along said longitudinal central axis with said inner surface of said thickening strips facing each other;

means for securing said folded fabric piece around said thickening strips; and a spine member located between said inner surfaces of said thickening strips at said tab end of said belt.

2. A belt as set forth in claim 1 including a metal tab attached to said tab end of said elongated fabric piece.

3. A belt as set forth in claim 1 wherein said thickening strips are a polyurethane.

4. A belt as set forth in claim 1 wherein said means for securing said folded fabric piece is a plurality of rows of stitching extending along substantially the entire length of said belt.

5. A belt as set forth in claim 1 wherein said folded fabric piece, said thickening strips and said spine member have a thickness adjacent said tab end of 0.160 inch ±0.003 inch.

6. A belt as set forth in claim 1 wherein said folded fabric piece and said thickening members have a thickness of 0.130 inch ±0.003 inch.

7. A belt as set forth in claim 1 wherein each of said thickening strips has a width less than one-half said finite width of said elongated fabric piece.

8. A belt as set forth in claim 7 wherein each of said thickening strips has a length substantially the same as said finite length of said elongated fabric piece.

9. A belt as set forth in claim 1 wherein each of said thickening strips has a width and said spine member has a tab end having a width less than the width of said thickening strips and wherein said tab end of said spine member is longitudinally recessed from said tab end of each of said thickening strips and of said elongated fabric piece.

10. A belt for use with a clamp type buckle having a sliding cinch bar, said belt comprising:

an elongated fabric piece having a finite length, a finite width and a tab end, a buckle attachment end opposite said tab end, a longitudinal central axis, a pair of substantially parallel outer edges on opposed parallel surfaces;

two elongated thickening strips having a finite length and a finite width and extending along substantially said finite length of said elongated fabric piece and having an outer surface attached to a surface of said elongated fabric piece at an inner surface thereof;

a spine member sandwiched between said inner surfaces of said two thickening strips adjacent to said tab end, wherein said spine member has a length substantially less than said finite length of said elongated thickening strips, wherein said elongated fabric piece is folded along said longitudinal central axis thereof around said thickening strips and said spine member; and means for securing said folded fabric piece around said thickening strips and said spine member.

11. A belt as set forth in claim 10 including a metal tab attached to said tab end of said elongated fabric piece.

12. A belt as set forth in claim 10 wherein said thickening strips and said spine member are a polyurethane.

13. A belt as set forth in claim 10 having a finite length and wherein said means for securing said folded fabric piece is a plurality of rows of stitching extending along substantially said finite length of said belt.

14. A belt as set forth in claim 10 wherein the width of each of said thickening strips is less than one-half said finite width of said elongated fabric piece.

15. A belt as set forth in claim 14 wherein said finite length of each of said thickening strips is substantially the same as said finite length of said elongated fabric piece.

16. A belt as set forth in claim 15 wherein said spine member has a tab end having a width less than said width of each of said thickening strips and wherein said tab end of said spine member is longitudinally recessed from said tab end of each of said thickening strips and of said elongated fabric piece.

17. A method for making a belt for use with a clamp type buckle having a sliding cinch bar, said method comprising the steps of:

cutting a fabric to form an elongated substantially rectangular fabric piece having a longitudinal central axis, a tab end, a buckle attachment end, two substantially parallel outer edges on opposite sides of said longitudinal central axis and outer and inner surfaces;

placing a pair of elongated substantially rectangular thickening strips having outer and inner surfaces and outer edges on said fabric piece such that said outer surfaces of said thickening strips contact said inner surface of said elongated fabric piece, wherein said thickening strips are adjacent each other and said outer edges of said thickening strips are inwardly spaced from said outer edges of said elongated fabric piece to form flap portions on said elongated fabric piece;

inserting a spine member between said opposed surface of thickening strips adjacent to said tab end of said elongated fabric piece;

folding said flap portions of said elongated fabric piece around said outer edges of said elongated thickening strips into contact with said inner surfaces of said thickening strips;

folding said fabric piece around said longitudinal central axis until said flap portions are opposed; and securing said thickening strips and said folded elongated fabric piece together to form said belt.

18. The method set forth in claim 17 including affixing a metal tab to said tab end of said elongated fabric piece of said belt.

19. The method set forth in claim 17 including securing said thickening strips and said elongated fabric piece by stitching.

* * * * *